US006495094B1

(12) United States Patent
Fukumori et al.

(10) Patent No.: US 6,495,094 B1
(45) Date of Patent: Dec. 17, 2002

(54) APPARATUS AND METHOD FOR SUPPRESSING GROWTH OF OXIDE FILM ON COIL

(75) Inventors: Junso Fukumori, Hiroshima (JP); Akira Kaya, Hiroshima (JP); Tsutomu Kawamizu, Hiroshima (JP); Kyung Zoon Min, Pohang (KR); Sung Doo Kim, Pohang (KR)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 51 days.

(21) Appl. No.: 09/708,502

(22) Filed: Nov. 9, 2000

(30) Foreign Application Priority Data

Nov. 9, 1999 (JP) ..... 11-318012

(51) Int. Cl.[7] ..... C21B 3/00
(52) U.S. Cl. ..... 266/274; 266/287; 432/260
(58) Field of Search ..... 266/262, 260, 266/287, 264, 274; 148/601; 432/260; 242/170, 174, 160.4

(56) References Cited

U.S. PATENT DOCUMENTS 1,870,577 A * 8/1932 Lamb ..... 432/260
2,495,561 A * 1/1950 Wilson ..... 266/252
2,818,170 A * 12/1957 Hogan ..... 242/170
2,880,861 A * 4/1959 Sklar et al. ..... 242/170
3,443,800 A * 5/1969 Kennedy ..... 432/260
3,580,331 A * 5/1971 Wargo ..... 266/252
3,879,167 A * 4/1975 De Luca et al. ..... 432/260
4,147,506 A * 4/1979 Southern et al. ..... 266/262
4,165,868 A * 8/1979 Southern ..... 266/264

* cited by examiner

*Primary Examiner*—Scott Kastler
(74) *Attorney, Agent, or Firm*—Birch, Stewart, Kolasch & Birch, LLP

(57) ABSTRACT

An apparatus and a method for suppressing growth of an oxide film on a coil which is a spirally wound, rolled strip are disclosed. A rolled strip subjected to rolling by hot rolling equipment is wound spirally by a down-coiler to make a coil. Covers are disposed on the opposite sides of the coil such that heat resistant materials intimately contact the opposite sides of the coil. The covers are fixed by L-bolts and nuts to cover the opposite sides of the coil with the covers. In this state, the coil is naturally cooled for a predetermined time to suppress growth of an oxide film and increase productivity.

3 Claims, 10 Drawing Sheets

Apparatus for Suppressing Growth of Oxide Film on Coil according to First Embodiment Apparatus for Suppressing Growth of Oxide Film on Coil according to First Embodiment Apparatus for Suppressing Growth of Oxide Film on Coil according to Second Embodiment Apparatus for Suppressing Growth of Oxide Film on Coil according to Third Embodiment Apparatus for Suppressing Growth of Oxide Film on Coil according to Fourth Embodiment (a)

(b)

APPARATUS AND METHOD FOR SUPPRESSING GROWTH OF OXIDE FILM ON COIL

BACKGROUND OF THE INVENTION

1. Field of the Invention

The present invention relates to an apparatus and a method for suppressing growth of an oxide film on a coil of a rolled strip which has been wound from hot rolling equipment onto a down-coiler and stored in a coil yard.

2. Description of the Related Art

FIGS. 13(*a*) and 13(*b*) schematically show a general state of storage of the coils. FIG. 14 is a graph showing the thickness of an oxide film, in the width direction, on the coil in a conventional state of storage.

A rolled strip after rolling in hot rolling equipment is wound spirally by a down-coiler, carried to a coil yard, and stored there. The posture of the coil in storage is a vertical posture of a coil C as shown in FIG. 13 (*a*), or a horizontal posture of the coil C as shown in FIG. 13(*b*). In this posture of storage, the coils are placed in a layer, or stacked in layers, on a frame (not shown). The coils stored in that posture are cooled by natural ventilation or by forced cooling in a building for about 110 hours in summer, or about 80 hours in winter.

In the above posture of coil storage, the rolled strip is cooled in the coil yard while being left to stand for a long time at a high temperature in an oxidizing atmosphere of the air. Thus, an oxide film grows on the surface of the coil over a long time. In the case of the coil of the rolled strip spirally wound, both of its edges directly touch the air. From the edges, air penetrates the gap between the adjacent turns of the rolled strip. Consequently, the oxide film growing on the strip surface of the coil differs in thickness across its width direction.

The graph indicated in FIG. 14 shows the thickness of the oxide film in the width direction of the coil. During rolling, the oxide film is formed uniformly to a thickness of 8 $\mu$m, and then the coil is cooled for a predetermined period of time in the coil yard. As shown in this graph, the oxide film on the strip surface of the coil grows to a thickness of 18 $\mu$m at the edge, 15 $\mu$m at a distance of 50 mm from the edge, 9 $\mu$m at a distance of 300 mm from the edge, and 8.5 $\mu$m at a distance of 470 mm from the edge (i.e., at a central position in the width direction). One will see that when the rolled strip in the coiled form is cooled, the oxide film grows to a thickness of 8.5 $\mu$m at the central position in the width direction, but to a thickness of 18 $\mu$m, a value more than two-fold, at the edge.

The rolled strip having the oxide file formed on the surface thereof is generally acid pickled to remove the oxide film. Then, the rolled strip is transported to a subsequent step such as a plating line. The acid pickling of the rolled strip is performed by guiding the rolled strip into an acid pickling tank holding an acidic liquid, and immersing the rolled strip therein for a predetermined time, thereby cleaning off the oxide film formed on the surface. That is, the duration of immersion of the rolled strip in the acid pickling tank is set in accordance with the thickness of the oxide film formed on the surface of the rolled strip. Hence, the rolled strip, which has the oxide film 8.5 $\mu$m thick at the central position and 18 $\mu$m at the edge, needs to be immersed in the acid pickling tank for a long time adapted for the oxide film which is 18 $\mu$m in thickness. As a result, the transport speed of the rolled strip in the acid pickling is slowed, decreasing the overall production efficiency. When the thickness of the oxide film formed on the surface of the rolled strip is great, moreover, the consumption of the acidic liquid used increases, raising the pickling cost.

SUMMARY OF THE INVENTION

The present invention has been accomplished to solve the above-described problems with the earlier technologies. It is an object of this invention to provide an apparatus and a method for suppressing growth of an oxide film on a coil of a rolled strip by properly storing and cooling the coil, while achieving an increase in productivity.

An aspect of the invention, as a means of attaining the above, object, is an apparatus for suppressing growth of an oxide film on a coil which is a spirally wound, rolled strip, wherein covers are provided for covering at least opposite sides of the coil.

Thus, the opposite sides of the coil are cooled while being shielded from the outside air. Penetration of air into the interior of the coil is inhibited, the growth of the oxide film on the rolled strip (coil), especially at its edge, is suppressed, and the formation of an extremely thick oxide film at the edge as compared with the center in the width direction can be prevented. As a result, the coil has a thin oxide film overall, and widthwise is leveled in thickness. The acid pickling time for cleaning off the oxide film can be markedly decreased, and the transport speed of the rolled strip during acid pickling can be increased, whereby the overall production efficiency can be raised. The consumption of the acidic liquid used can also be decreased to reduce the pickling cost.

In the apparatus for suppressing growth of an oxide film on a coil, a heat insulating material may be provided on a surface of each of the covers in intimate contact with the coil. By this measure, rapid local cooling of the coil is prevented, and penetration of air into the interior of the coil is reliably inhibited. Consequently, the formation of an extremely thick oxide film at the edge compared with the center in width direction can be prevented. The resulting oxide film is thin overall, and widthwise is leveled in thickness In the apparatus for suppressing growth of an oxide film on a coil, each of the covers may be shaped like a ring having a through-hole at a center thereof, and eye rings formed to project toward the through-holes of the covers may be connected together and fixed by bolts and nuts. By these measures, the covers can be mounted easily on the coil.

In the apparatus for suppressing growth of an oxide film on a coil, a cooling water path may be provided in each of the covers. By this measure, the coil is forcibly cooled with cooling water, with its opposite sides being shielded from the outside air. Consequently, the cooling time can be shortened, and the storage time of the coil in the coil yard can be reduced.

In the apparatus for suppressing growth of an oxide film on a coil, each of the covers may be shaped like a disk having a flange portion in an outer peripheral area of the cover, and the cooling water path may be provided along a circumferential direction of the cover. Since the cooling water path becomes long, the cooling efficiency can be increased.

In the apparatus for suppressing growth of an oxide film on a coil, the covers may be provided with a supply path and a discharge path for supplying and discharging an inert gas into and from a hollow portion of the coil. By this measure, the opposite sides of the coil are shielded from the outside air, and the hollow portion of the coil is supplied with the inert gas. Thus, penetration of air into the interior of the coil is inhibited, and the oxidizing atmosphere inside the coil is purged with the inert gas. Consequently, growth of the oxide film on the rolled strip can be suppressed reliably.

In the apparatus for suppressing growth of an oxide film on a coil, each of the covers may be shaped like a disk having a flange portion in an outer peripheral area of the cover, and the supply path and the discharge path for the inert gas which communicate with the hollow portion of the coil may be provided in the center of the covers. By this measure, a simple constitution can increase the cooling efficiency.

In the apparatus for suppressing growth of an oxide film on a coil, the covers may be a cup for accommodating the coil and a cup for covering an opening of the cup. By so doing, the coil can be cooled, with its whole being shielded from the outside, so that the growth of the oxide film on the rolled strip can be suppressed reliably.

Another aspect of the invention is a method for suppressing growth of an oxide film on a coil which is a spirally wound, rolled strip, comprising cooling the coil while covering at least opposite sides of the coil with covers.

Thus, penetration of air into the interior of the coil can be inhibited, the growth of the oxide film on the rolled strip (coil), especially at its edge, can be suppressed, and the formation of an extremely thick oxide film at the edge compared with the center in the width direction can be prevented. As a result, the coil has a thin oxide film overall, and widthwise is leveled in thickness.

The method for suppressing growth of an oxide film on a coil may comprise cooling the coil while the heat insulating surfaces of the covers and the coil are in intimate contact with each other. By so doing, rapid local cooling of the coil is prevented, and penetration of air into the interior of the coil is reliably inhibited. Consequently, the formation of an extremely thick oxide film at the edge compared with the center in width direction can be prevented. The resulting oxide film becomes thin overall and widthwise is leveled in thickness.

The method for suppressing growth of an oxide film on a coil may comprise cooling the coil by flowing cooling water in a cooling water path provided in each of the covers. By so doing, the coil is forcibly cooled with cooling water, with its opposite sides being shielded from the outside sir. Consequently, the cooling time can be shortened, and the storage time of the coil in the coil yard can be reduced.

The method for suppressing growth of an oxide film on a coil may comprise cooling the coil while supplying and discharging an inert gas into and from a hollow portion of the coil. By so doing, the opposite sides of the coil are shielded from the outside air, and the hollow portion of the coil is supplied with the inert gas. Thus, penetration of air into the interior of the coil can be inhibited, and the oxidizing atmosphere inside the coil can be purged with the inert gas. Consequently, growth of the oxide film on the rolled strip can be suppressed reliably.

The method for suppressing growth of an oxide film on a coil may comprise cooling the coil in an accommodated state. By so doing, the coil can be cooled, with its whole being shielded from the outside, so that the growth of the oxide film on the rolled strip can be suppressed reliably.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Embodiments of the present invention will now be described in detail with reference to the accompanying drawings, which in no way limit the invention.

[First Embodiment]

Figure 1:
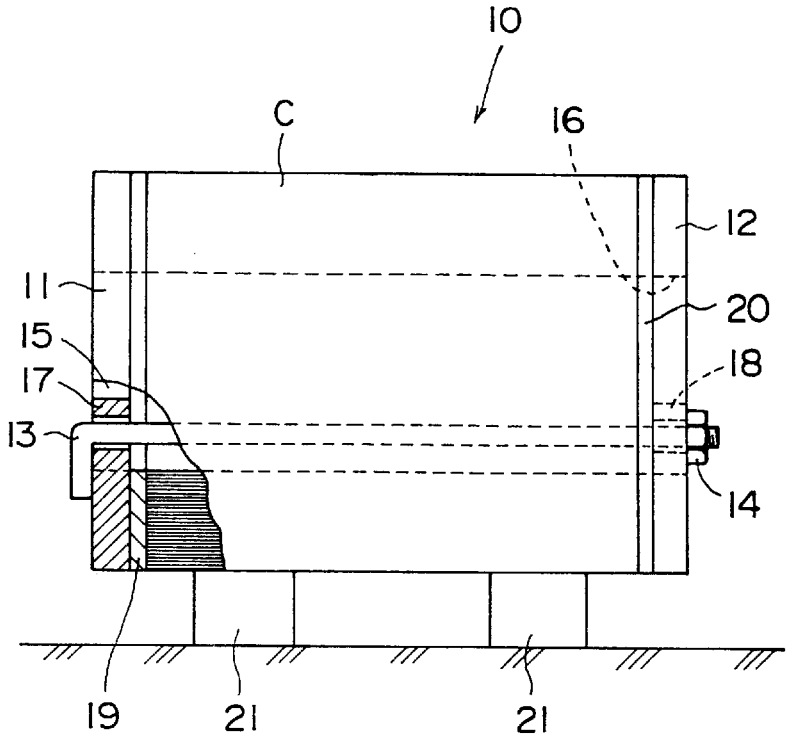
FIG. 1 is a partially cutaway front view of an apparatus for suppressing growth of an oxide film on a coil according to a first embodiment of the present invention, designed to carry out a method for suppressing growth of an oxide film on a coil.
Figure 2:
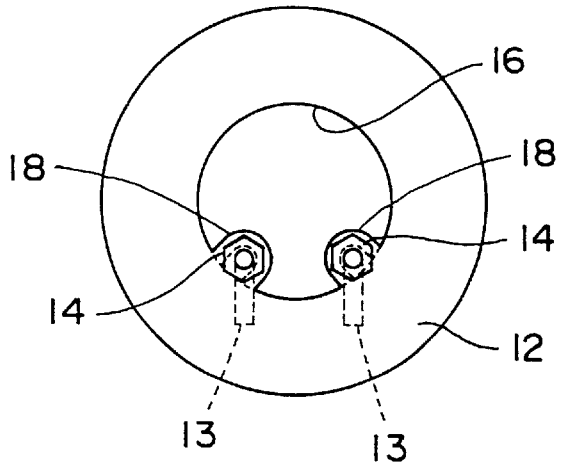
FIG. 2 is a side view of the apparatus for suppressing growth of an oxide film on a coil.
Figure 3:
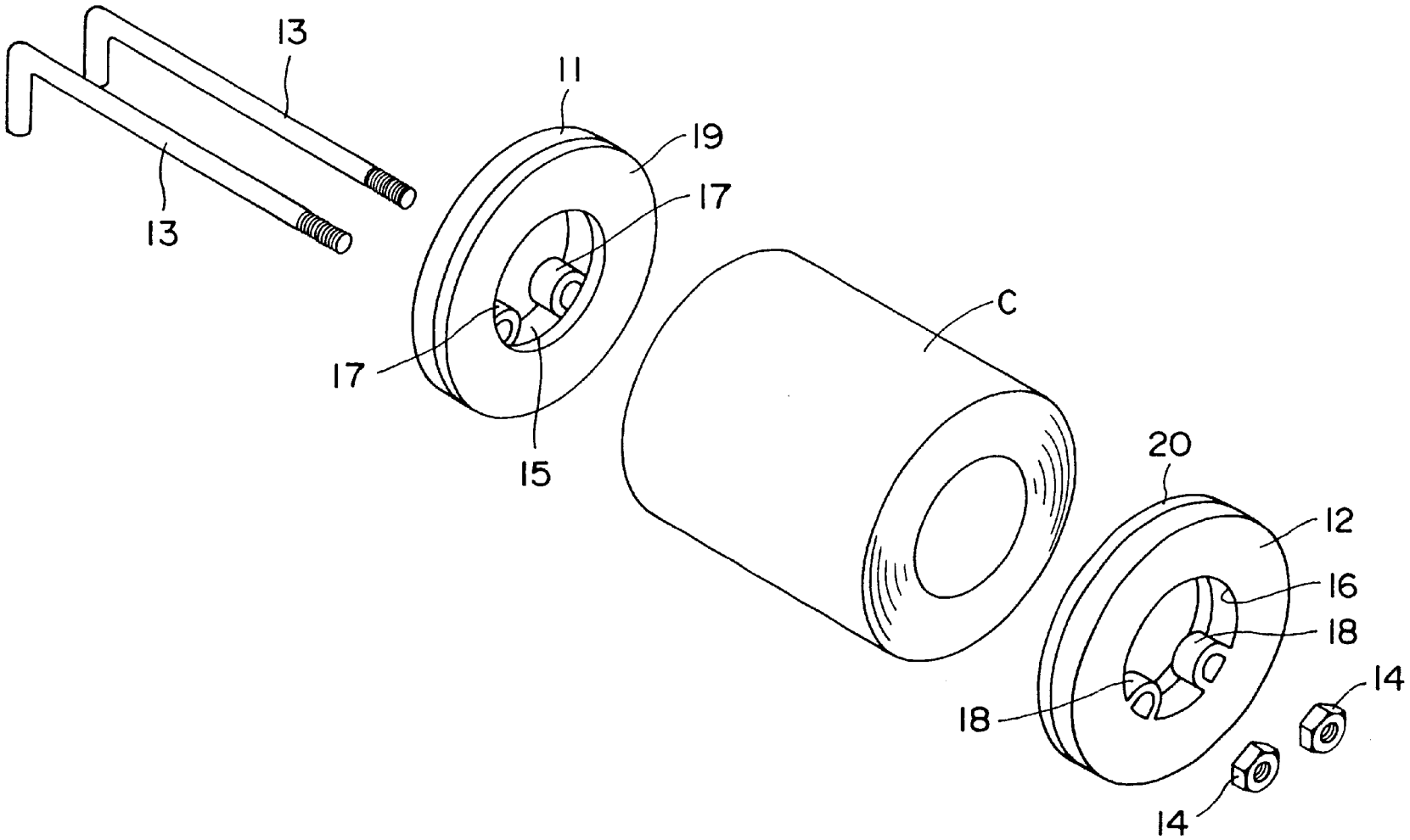
FIG. 3 is an exploded perspective view of the apparatus for suppressing growth of an oxide film on a coil.
Figure 4:
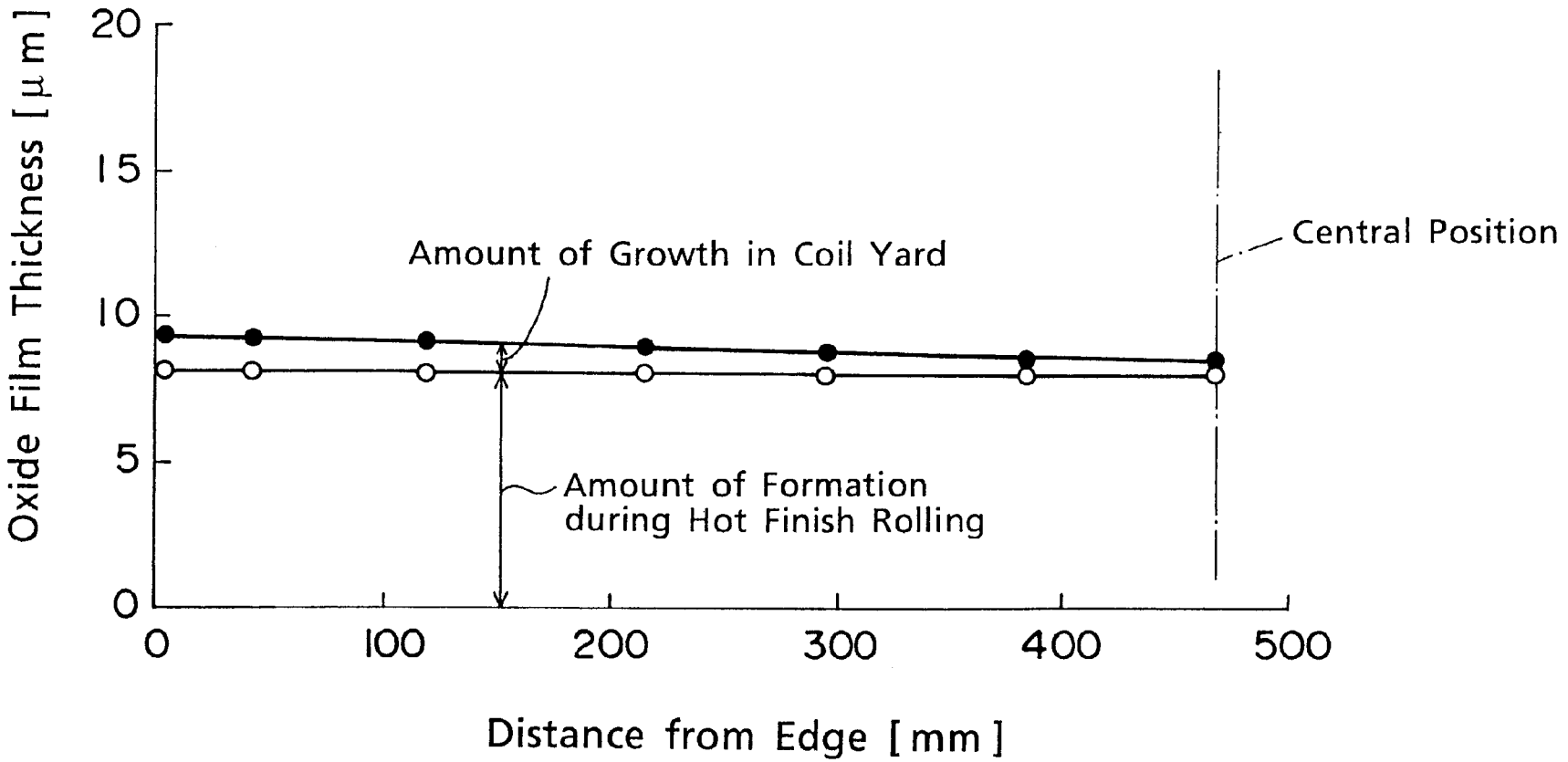
FIG. 4 is a graph showing the thickness of an oxide film in the width direction of a coil in the apparatus for suppressing growth of the oxide film on the coil according to the first embodiment.

FIG. 1 is a partially cutaway front view of an apparatus for suppressing growth of an oxide film on a coil according to a first embodiment of the invention, designed to carry out a method for suppressing growth of an oxide film on a coil. FIG. 2 is a side view of the apparatus for suppressing growth of an oxide film on a coil. FIG. 3 is an exploded perspective view of the apparatus for suppressing growth of an oxide film on a coil. FIG. 4 is a graph showing the thickness of an oxide film in the width direction of a coil in the apparatus for suppressing growth of the oxide film on the coil according to the present embodiment.

As shown in FIGS. 1 to 3, a coil C is rolled by hot rolling equipment (not shown), and then spirally wound by a down-coiler. The resulting coil is transported to a coil yard, where it is stored by an apparatus 10 for suppressing growth of an oxide film on a coil according to the present embodiment. This apparatus 10 is composed of a pair of covers (right and left covers) 11, 12 for covering opposite sides of the coil C, and two L-bolts 13 and two nuts 14 as connectors for fixing the covers 11, 12 to the opposite sides of the coil C. The covers 11, 12 are of the same structure, and have nearly the same diameter as (or a slightly larger diameter than) the diameter of the coil C. The covers 11 and 12 are shaped like rings having through-holes 15 and 16, respectively, in the center. On the inner peripheral surface of the through-holes 15 and 16, two eye rings 17 and two eye rings 18 are fixed. To the interior surface of each of the covers 11 and 12, layers of heat resistant materials 19 and 20 having certain elasticity and heat insulating properties are attached which have a ring shape to be brought into intimate contact with the respective edges of the coil C. The reference numeral 21 denotes a coil storing frame for bearing the coil C.

A rolled strip subjected to rolling by the hot rolling equipment is wound spirally by the down-coiler to make a coil C. The coil C is transported to the coil yard, and is borne on the coil storing frame 21. On the coil storing frame 21, the covers 11, 12 are disposed on the opposite sides of the coil C such that the heat resistant materials 19, 20 intimately contact the opposite sides of the coil C. The L-bolts 13 are passed through the eye rings 17 of one cover 11, the hollow core of the coil C, and the eye rings 18 of the other cover 12, whereafter the nuts 14 are screwed on the front end portions of the L-bolts 13. In this manner, the covers 11, 12 are mounted on the coil C so as to cover its opposite sides.

When the covers 11, 12 have been mounted on the opposite sides of the coil C via the heat resistant materials 19, 20, the coil C is naturally cooled in this condition for a predetermined period of time in the coil yard. During this cooling treatment, the covers 11 and 12 are mounted on the opposite sides of the coil C via the heat resistant materials 19, 20 to close open ends of the gap between the adjacent spiral turns of the rolled strip in the coil C, thereby inhibiting penetration of air into the interior of the coil C. Thus, growth of an oxide film on the rolled strip (coil C), especially at its edge, is suppressed, and the formation of an oxide film which is extremely think at the edge compared with the center in the width direction can be prevented.

The graph as FIG. 4 shows the thickness of the oxide film in the width direction of the coil C which has been cooled for a predetermined time in the coil yard after the oxide film was formed uniformly to a thickness of 8 $\mu$m during rolling. As shown in this graph, the thickness of the oxide film growing on the strip surface of the coil is 9.5 $\mu$m at the edge, and 8.5 $\mu$m at a distance of 470 mm from the edge (i.e., at the central position in the width direction). There is substantially no difference between the two thicknesses, indicating that the thickness of the oxide film is almost leveled in the width direction.

The above finding points to the prevention of the phenomenon that the oxide film becomes extremely thick only at the edge during cooling of the coil C after rolling. The overall thickness of the oxide film becomes small. The acid pickling time for cleaning off the oxide film can be markedly decreased, and the transport speed of the rolled strip during acid pickling can be increased, whereby the overall production efficiency can be raised. The consumption of the acidic liquid used can also be decreased to reduce the pickling cost. Furthermore, wasteful removal of the material other than the oxide film, namely, the base material, is decreased, and the quality of the product can be improved.

[Second Embodiment]

Figure 5:
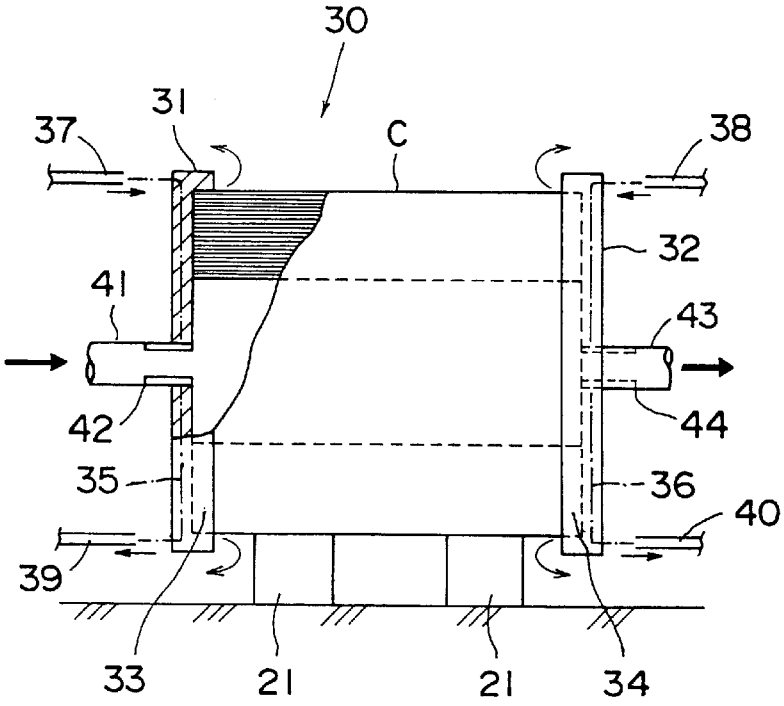
FIG. 5 is a partially cutaway front view of an apparatus for suppressing growth of an oxide film on a coil according to a second embodiment of the invention.
Figure 6:
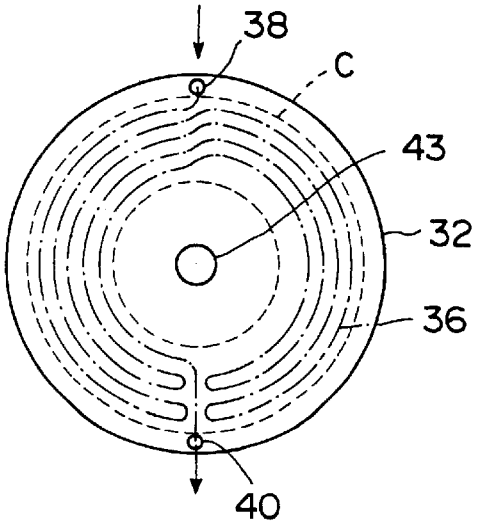
FIG. 6 is a side view of the apparatus for suppressing growth of an oxide film on a coil.
Figure 7:
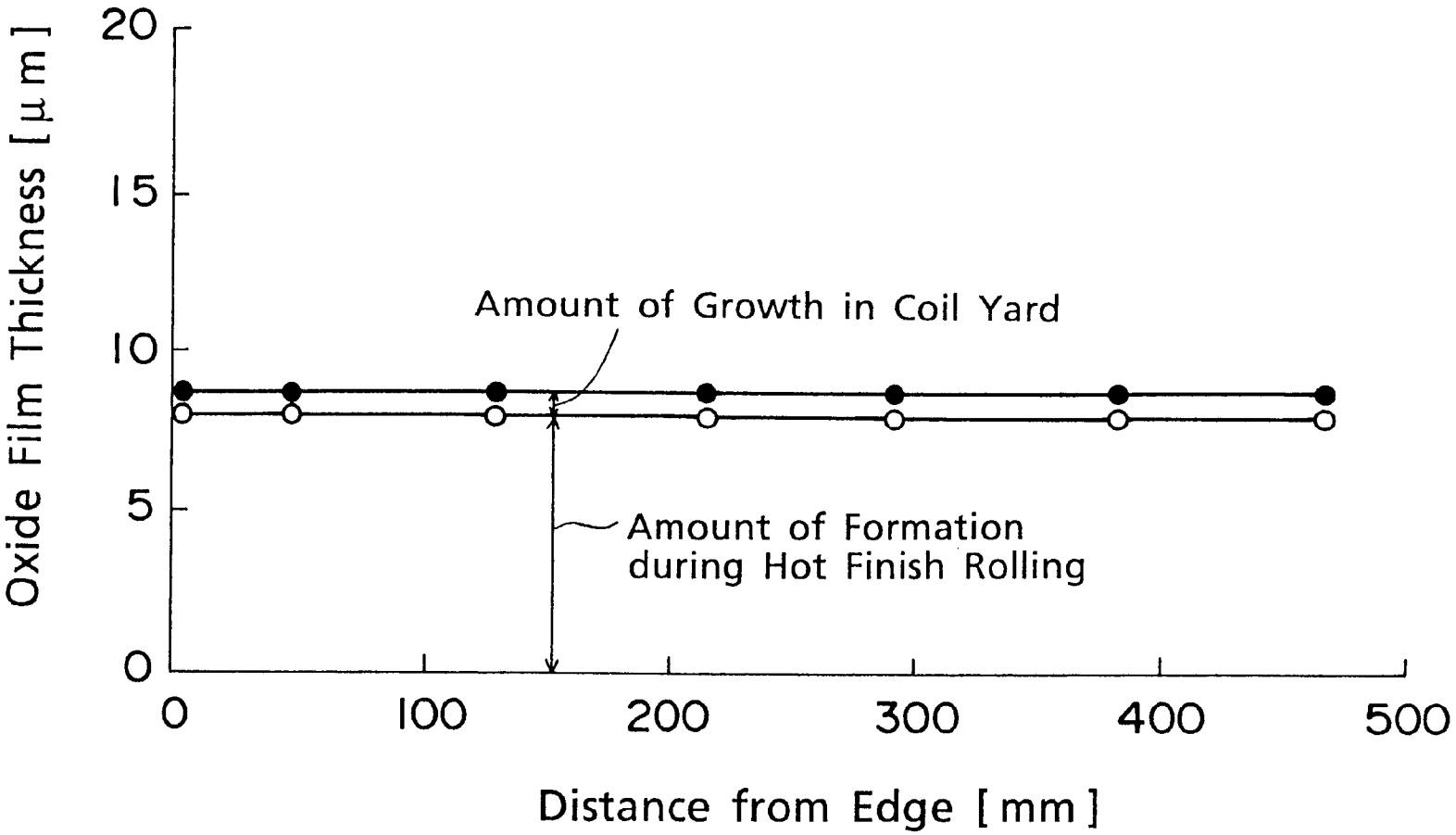
FIG. 7 is a graph showing the thickness of an oxide film in the width direction of a coil in the apparatus for suppressing growth of the oxide film on the coil according to the second embodiment.
Figure 8:
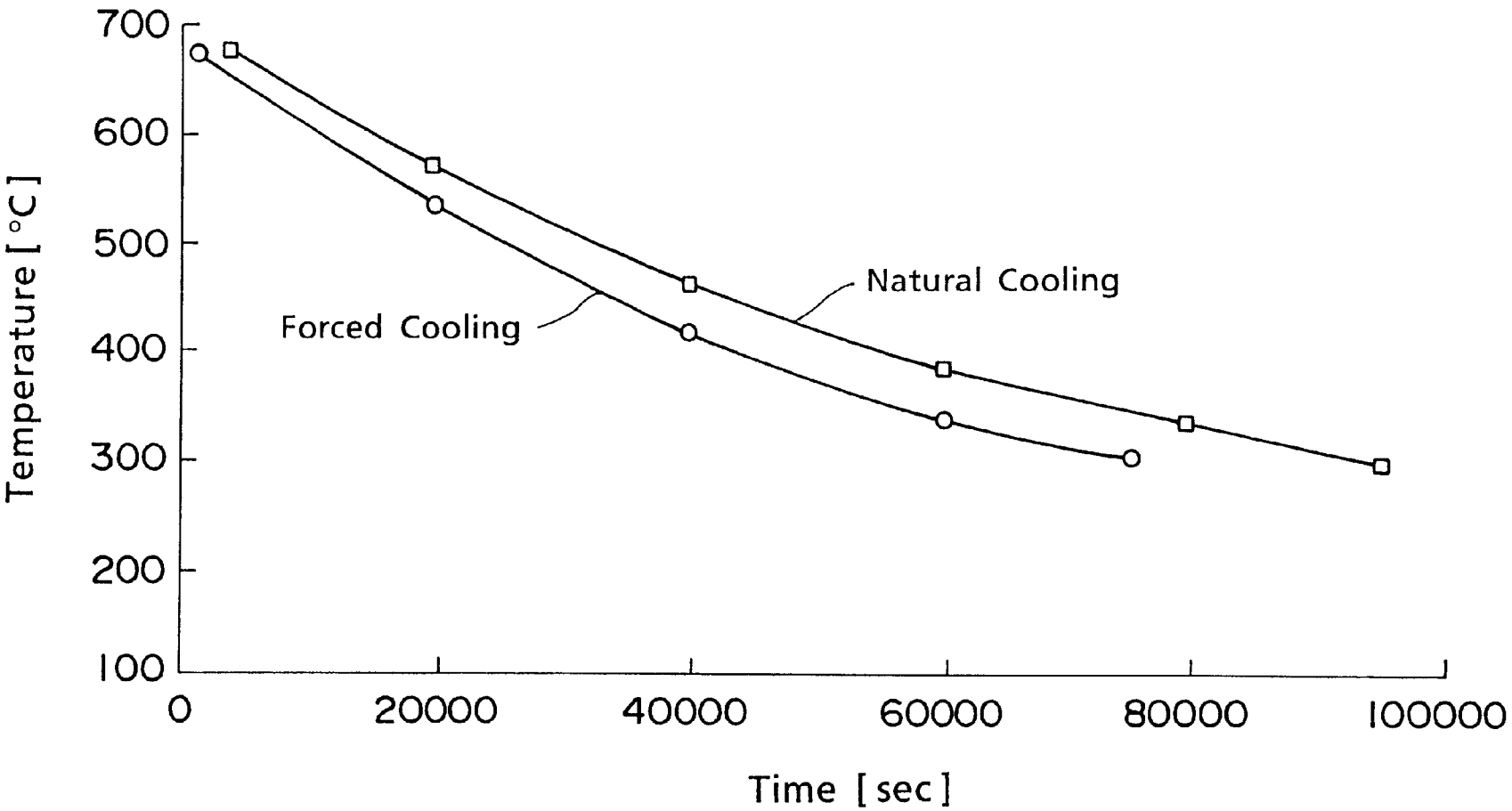
FIG. 8 is a graph showing the temperature of the coil versus the cooling time for the coil.

FIG. 5 is a partially cutaway front view of an apparatus for suppressing growth of an oxide film on a coil according to a second embodiment of the invention. FIG. 6 is a side view of the apparatus for suppressing growth of an oxide film on a coil. FIG. 7 is a graph showing the thickness of an oxide film in the width direction of a coil in the apparatus for suppressing growth of the oxide film on the coil according to the present embodiment. FIG. 8 is a graph showing the temperature of the coil versus the cooling time for the coil. Members having the same functions as illustrated in the above-mentioned embodiment are assigned the same reference numerals, and their explanations will be omitted.

As shown in FIGS. 5 and 6, an apparatus 30 for suppressing growth of an oxide film on a coil has a pair of covers (right and left covers) 31 and 32 fitted on a coil C so as to cover its opposite sides. In each of the covers 31 and 32, a cooling water path is provided, and a supply path and a discharge path are provided for supplying and discharging an inert gas into and from the hollow portion of the coil C. The covers 31, 32 are of the same structure, and have a slightly larger diameter than the diameter of the coil C. The covers 31 and 32 are shaped like disks having flange portions 33 and 34 in the outer peripheral area of the cover, the flange portions 33 and 34 being fitted around the outer periphery at each end of the coil C. In the covers 31 and 2, cooling water channels 35 and 36 are formed as the cooling water paths. One end of each of the cooling water channels 35, 36 is connected to a cooling water source (not shown) via cooling water supply pipes 37, 38 joined to upper parts of the covers 31, 32. The other end of each of the cooling water channels 35, 36 is coupled to cooling water discharge pipes 39, 40 joined to lower parts of the covers 31, 32. Cooling water from cooling equipment may be forcibly passed through the cooling water channels 35, 36 by a pump. And after cooling, may be circulated to the cooling equipment. To one of the covers, 31, a gas supply pipe 41 for supplying an inert gas into the hollow portion of the coil C is connected via a pipe joint 42. To the other cover, 32, a gas discharge pipe 43 for discharging the inert gas, which has been supplied into the hollow portion of the coil C, is connected via a pipe joint 44. As the inert gas, a $N_2$ gas or a Ar gas is preferred in order to purge an oxidizing atmosphere from the coil. Such an inert gas may be forced into the hollow portion of the coil C at room temperature by a pump.

The coil C borne on a coil storing frame 21 is mounted by having its opposite sides fitted with the flange portions 33 and 34 of the covers 31 and 32. By forcibly flowing cooling water from the cooling equipment into the cooling water channels 35 and 36 via the cooling water supply pipes 37 and 38 by means of the pump, the coil C is indirectly cooled. Also, by forcibly flowing the inert gas from the gas supply pipe 41 into the hollow portion of the coil C via the pipe joint 42 by means of the pump, the coil C is cooled, and the oxidizing atmosphere is purged. In this manner, the coil C is forcibly cooled for a predetermined time in the coil yard.

During this cooling treatment, the covers 31 and 32 are attached to the opposite sides of the coil C to close the open ends of the gap between the spiral turns of the rolled strip in the coil C. Thus, penetration of air into the interior of the coil C is inhibited. At the same time, the inert gas is supplied into the hollow portion of the coil C to purge the inside oxidizing atmosphere. Hence, growth of an oxide film on the rolled strip (coil C) is suppressed, and the formation of an oxide film which is extremely thick at the edge compared with the center in the width direction is prevented. That is, as shown in FIG. 7, the thickness of the oxide film growing on the strip surface of the coil C is smaller than 9 $\mu$m at the central position in the width direction, as well as the edge, indicating that the thickness of the oxide film is almost leveled in the width direction.

The graph as FIG. 8 shows the temperature of the coil versus the cooling time for the coil, making a comparison between natural cooling of the coil C allowed to stand in the coil yard, and forced cooling of the coil C performed by flowing cooling water in the covers 31 and 32 and flowing the inert gas into the hollow portion of the coil C. As this graph shows, the cooling time to a predetermined temperature is shortened by about 20% in the forced cooling in comparison with the natural cooling.

The above findings point to the prevention of the phenomenon that the oxide film becomes extremely thick only at the edge during cooling of the coil C after rolling. The overall thickness of the oxide film becomes small. The acid pickling time for cleaning off the oxide film can be markedly decreased, and the transport speed of the rolled strip during acid pickling can be increased, whereby the overall production efficiency can be raised. The consumption of the acidic liquid used cal also be decreased to reduce the pickling cost. Furthermore, wasteful removal of the material other than the oxide film, namely, the base material, is decreased, and the quality of the product can be improved. Besides, the coil C is forcibly cooled to shorten the cooling time. Thus, the storage time of the coil C in the coil yard can be reduced.

In the present embodiment, the covers 31, 32 have been mounted by fitting the flange portions 33, 34 onto the opposite sides of the coil C. However, joints may be formed on the outer periphery of the covers 31, 32, and L-bolts and nuts may be used supplementally to fix the covers 31, 32, as in the aforementioned embodiment.

[Third Embodiment]

Figure 9:
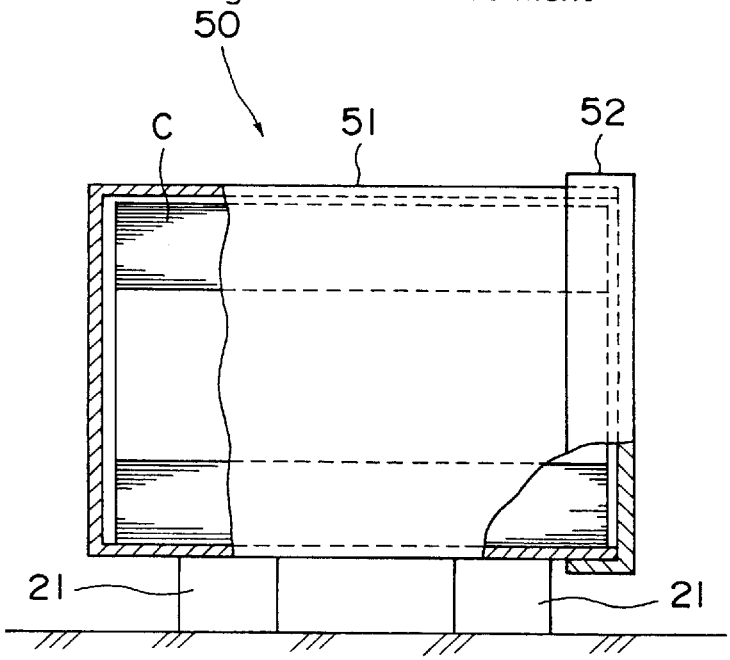
FIG. 9 is a partially cutaway front view of an apparatus for suppressing growth of an oxide film on a coil according to a third embodiment of the invention.
Figure 10:
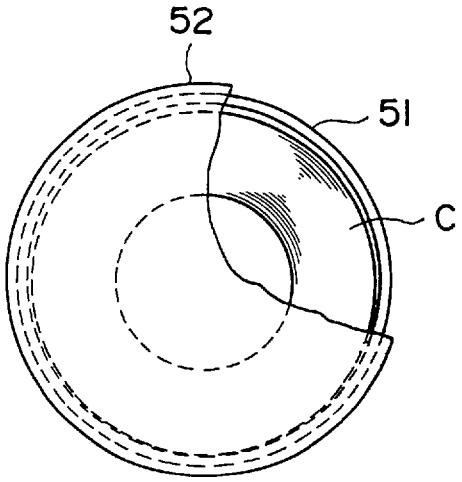
FIG. 10 is a side view of the apparatus for suppressing growth of an oxide film on a coil.

FIG. 9 is a partially cutaway front view of an apparatus for suppressing growth of an oxide film on a coil according to a third embodiment of the invention. FIG. 10 is a side view of the apparatus for suppressing growth of an oxide film on a coil.

As shown in FIGS. 9 and 10, an apparatus 50 for suppressing growth of an oxide film on a coil is comprised of a cup (cover) 51 for accommodating a coil C so as to cover a side portion of the coil C, and a cap 52 fitted on the cup 51 so as to cover the other side portion of the coil C. The cup 51 is made of steel, takes a cylindrical shape, and has an inner peripheral portion slightly larger in diameter than the coil C. The cap 52 is also made of steel, takes a cylindrical shape, and has an inner peripheral portion which can be fitted around an outer peripheral portion of the cup 51. The coil C is fitted within the cup 51 while being supported by an L-shaped fork. Then, the coil C is borne on a coil storing frame 21, and the cap 52 is fitted on the cup 51 to accommodate the coil C. When the coil C has been accommodated in the cup 51 and the cap 52 in this manner, the coil C is naturally cooled for a predetermined time in this state in the coil yard. During the cooling treatment, therefore, the coil C is shielded from the outside air, so that the growth of an oxide film on the rolled strip (coil C) is suppressed. This results in the prevention of the phenomenon that the oxide film becomes extremely thick only at the edge during cooling of the coil C after rolling. The overall thickness of the oxide film becomes small. Furthermore, the coil C is accommodated in the cup 51 and the cap 52 and naturally cooled over a long time. Hence, the ductility of the rolled strip (steel plate) can be improved because of an annealing effect.

[Fourth Embodiment]

Figure 11:
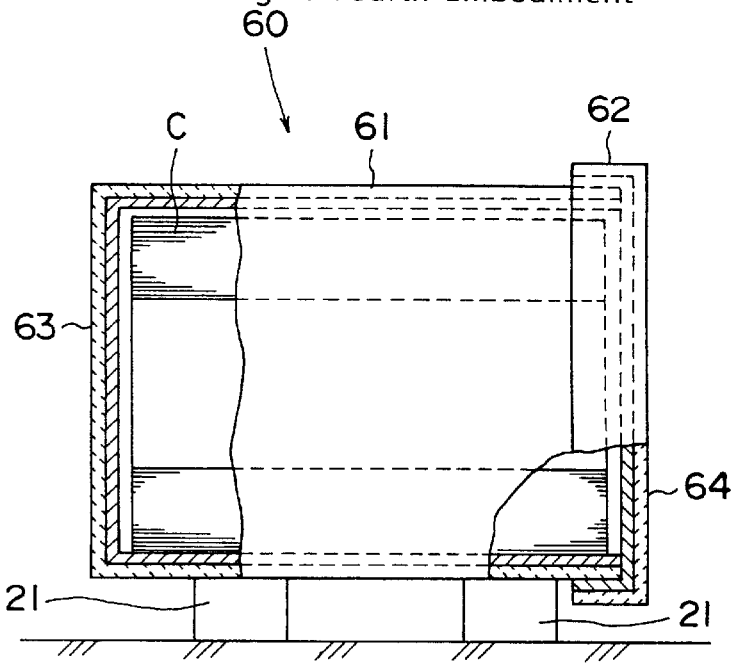
FIG. 11 is a partially cutaway front view of an apparatus for suppressing growth of an oxide film on a coil according to a fourth embodiment of the invention.
Figure 12:
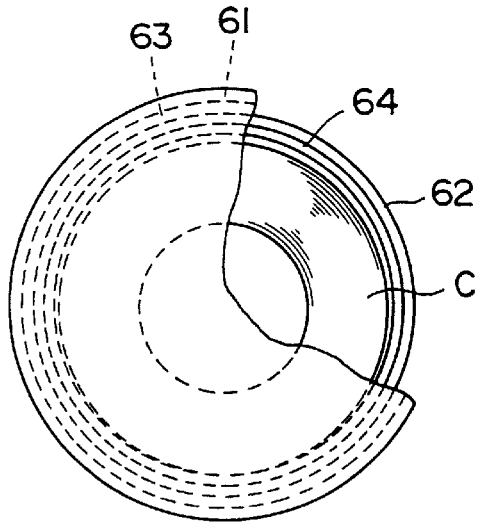
FIG. 12 is a side view of the apparatus for suppressing growth of an oxide film on a coil.
Figure 13:
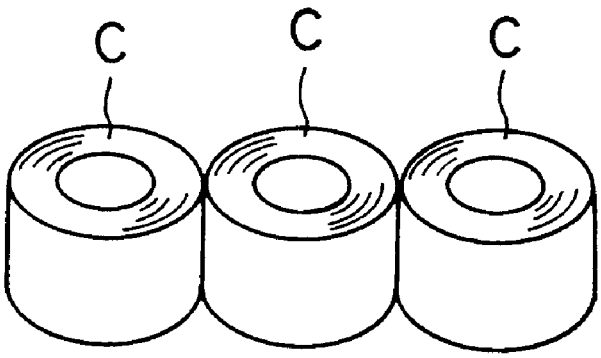
FIGS. 13(*a*) and 13(*b*) are each a schematic view showing a general storage state of the coils.
Figure 13:
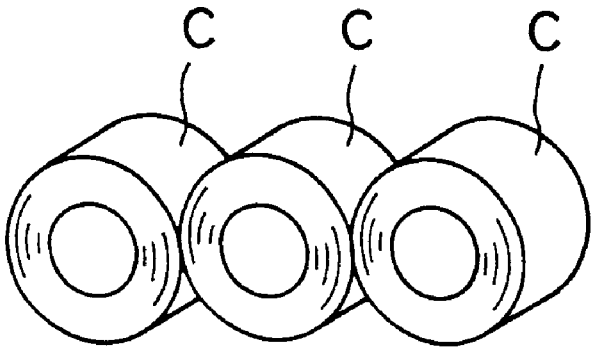
Figure 14:
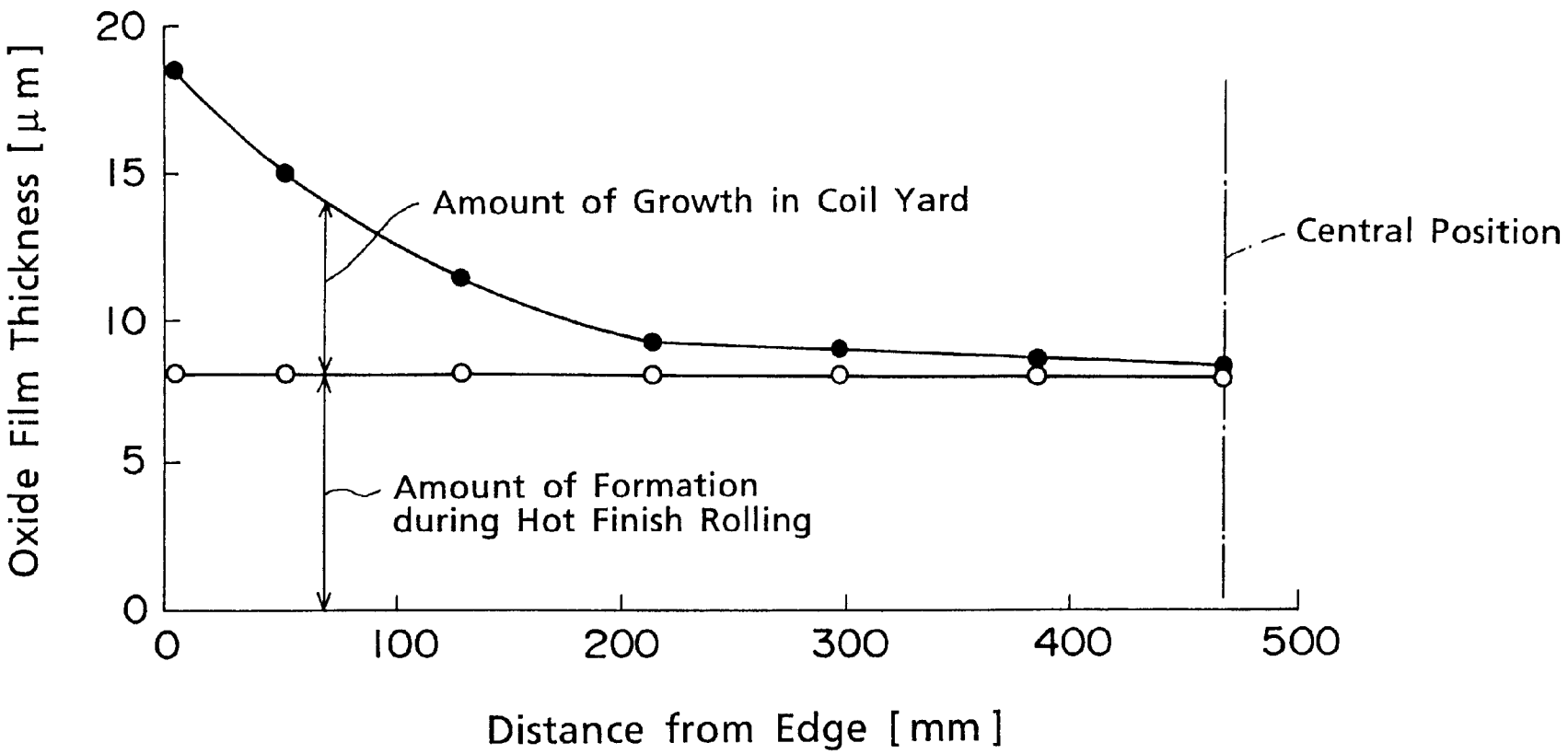
FIG. 14 is a graph showing the thickness of an oxide film in a width direction of a coil in a conventional storage state.

FIG. 11 is a partially cutaway front view of an apparatus for suppressing growth of an oxide film on a coil according to a fourth embodiment of the invention. FIG. 12 is a side view of the apparatus for suppressing growth of an oxide film on a coil.

As shown in FIGS. 11 and 12, an apparatus 60 for suppressing growth of an oxide film on a coil is comprised of a cup (cover) 61 for accommodating a coil C so as to cover a side portion of the coil C, and a cap 62 fitted on the cup 61 so as to cover the other side portion of the coil C. The cup 61 is made of steel, takes a cylindrical shape, and has a laminated structure in which a heat insulating material 63 is mounted on an inner peripheral portion of the cup 61. The cap 62 is also made of steel, takes a cylindrical shape, and has a laminated structure in which a heat insulating material 64 is mounted oh an inner peripheral portion of the cap 62. The coil C is fitted within the cup 61 while being supported by an L-shaped fork. Then, the coil C is borne on a coil storing frame 21, and the cap 62 is fitted on the cup 61 to accommodate the coil C. When the coil C has been accommodated in the cup 61 and the cap 62 in this manner, the coil C is naturally cooled in this state for a predetermined time in the coil yard. During the cooling treatment, therefore, the coil C is shielded from the outside air, so that the growth of an oxide film on the rolled strip (coil C) is suppressed. This results in the prevention of the phenomenon that the oxide film becomes extremely thick only at the edge during cooling of the coil C after rolling. The overall thickness of the oxide film becomes small. Furthermore, the coil C is accommodated in the cup 61 and the cap 62, and shielded from the outside by the heat insulating materials 63, 64. In this condition, the coil C is naturally cooled over a long time. Hence, the ductility of the rolled strip (steel plate) can be improved because of an annealing effect.

In the foregoing respective embodiments, the cover has been formed in many shapes. However, the cover may be any one which can cover the opposite sides of the coil, and is not restricted to these shapes. Furthermore, bolts and nuts, and flange fitting have been used as fixing tools for fixing the cover to the coil, but they are not limitative of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for suppressing growth of an oxide film on a coil which is a spirally wound, rolled strip, wherein:

covers are provided for covering at least opposite sides of the coil, each of the covers being shaped like a ring having a through-hole at a center thereof, eye rings being formed to project toward the through-holes of the covers are connected together and fixed by bolts and nuts, and a cooling water path is provided in each of the covers.

2. The apparatus for suppressing growth of an oxide film on a coil as claimed in claim 1, wherein:

a heat insulating material is provided on a surface of each of the covers in intimate contact with the coil.

3. The apparatus for suppressing growth of an oxide film on a coil as claimed in claim 1, wherein:

each of the covers is shaped like a disk having a flange portion in an outer peripheral area of the cover, and the cooling water path is provided along a circumferential direction of the cover.

* * * * *